US008118721B2

(12) United States Patent
Cieslikowski et al.

(10) Patent No.: US 8,118,721 B2
(45) Date of Patent: Feb. 21, 2012

(54) METHOD AND APPARATUS FOR COMPILING GROUPS OF FILTER SEGMENTS WHEN PRODUCING MULTI-SEGMENT FILTER ASEMBLIES

(75) Inventors: Bartosz Cieslikowski, Przysucha (PL); Ryszard Dominiak, Warsaw (PL); Leszek Sikora, Radom (PL)

(73) Assignee: Philip Morris USA Inc., Richmond, VA (US)

( * ) Notice: Subject to any disclaimer, the term of this patent is extended or adjusted under 35 U.S.C. 154(b) by 579 days.

(21) Appl. No.: 12/331,853

(22) Filed: Dec. 10, 2008

(65) Prior Publication Data

US 2009/0145449 A1 Jun. 11, 2009

(30) Foreign Application Priority Data

Dec. 10, 2007 (PL) ..... 383995

(51) Int. Cl.
*B31C 99/00* (2009.01)

(52) U.S. Cl. ..... 493/39; 493/45; 493/50; 493/941; 131/282

(58) Field of Classification Search ..... 493/39, 493/45, 48, 50, 941; 131/202, 280, 282, 131/340, 88
See application file for complete search history.

(56) References Cited

U.S. PATENT DOCUMENTS 2,882,970 A * 4/1959 Schur ..... 493/47
2,957,285 A * 10/1960 Molins ..... 493/47
3,009,557 A 11/1961 Jackson
3,199,418 A * 8/1965 Schubert ..... 493/41
3,267,821 A 8/1966 Rowlands
3,372,702 A * 3/1968 Schluter et al. ..... 131/94
(Continued)

FOREIGN PATENT DOCUMENTS

EP 1767107 A1 3/2007
(Continued)

OTHER PUBLICATIONS

International Search Report and Written Opinion mailed Mar. 17, 2009 for PCT/EP2008/067032.

*Primary Examiner* — Thanh Truong
(74) *Attorney, Agent, or Firm* — Buchanan Ingerstoll & Rooney PC

(57) ABSTRACT

A method of making segmented filters including moving substantially identical segments of one type at uniform rate to a transferring element, which places each segment separately on an exit path. Setting of the filter segments in a repeating group on the exit path is accomplished by delay in collecting segments by a transferring element in each module of the apparatus. Uniform positioning is effected using the transferring element which includes uniformly spaced drivers, and non-uniform positioning is effected using the transferring element with non-uniformly spaced drivers. The apparatus includes a guiding element positioned adjacent to a cutting drum and has a wall closing a channel for a set of segments drawn out of a flute on the drum. The filter set is led through the channel with the aid of a dog of a chain and is advanced by a worm surface of a pushing together drum. A separator positioned at the end of the channel which separates single filter segments and may be a disc cam pushing out the segment onto the transferring element between two neighbouring drivers into a chamber created by a supporting element. A stream of compressed air from nozzle directed towards the area between a shoe guide and separator helps separate and stabilize the filter segment.

27 Claims, 12 Drawing Sheets

U.S. PATENT DOCUMENTS

| | | | | |
|---|---|---|---|---|
| 3,550,750 | A | 12/1970 | Jackson | |
| 4,103,596 | A | 8/1978 | Molins | |
| 4,238,994 | A * | 12/1980 | Koch | 493/4 |
| 4,283,187 | A * | 8/1981 | Molins et al. | 493/48 |
| 4,287,979 | A * | 9/1981 | Molins et al. | 198/418.2 |
| 4,411,640 | A * | 10/1983 | Hall | 493/45 |
| 7,435,208 | B2 * | 10/2008 | Garthaffner | 493/39 |
| 2004/0237972 | A1 | 12/2004 | Horn et al. | |
| 2005/0077149 | A1 * | 4/2005 | Wohltmann | 198/475.1 |

FOREIGN PATENT DOCUMENTS

| | | |
|---|---|---|
| FR | 2354719 | 1/1978 |
| GB | 971491 | 9/1964 |
| GB | 1578738 | 5/1980 |
| WO | WO03/024898 A2 | 3/2003 |

* cited by examiner

METHOD AND APPARATUS FOR COMPILING GROUPS OF FILTER SEGMENTS WHEN PRODUCING MULTI-SEGMENT FILTER ASEMBLIES

CROSS-REFERENCE TO RELATED APPLICATION

This application claims priority under 35 U.S.C. §119 to Polish Application No. P383995, filed Dec. 10, 2007, the entire content of which is hereby incorporated by reference.

BACKGROUND AND SUMMARY

The subject of the invention is a method and apparatus for compiling or arranging groups of filter segments in a continuous endwise manner in a process of producing multi-segment filters used in tobacco industry for cigarettes.

There is a demand in tobacco industry for multi-segment filters used in producing cigarettes. The filters consisting of at least two types of segments made of different filtrating materials. They may be soft filters filled with, e.g., fibrous material, paper, monoacetate or hard segments filled with granulate, sinter elements or hollow cylinders. A compiled set of filter segments is then divided into filters used for producing cigarettes. One method of compiling multi-segment filters is a crosswise method, the principle of which has been presented many times in patent descriptions belonging to a German company HAUNI AG.

One such description is a published USA patent application No. US 2004/237972 A1 dealing with an apparatus for compiling groups of filter segments for producing multi-segment filters in a continuous manner, operating in the crosswise method. The apparatus is separated or divided into a certain number of individual functional units or modules set or arranged together. At least two different types of filter segments are used in each produced multi-segment filter. The filter segments are transported and forwarded by properly set or arranged drums, on which cutting of filter segments and arranging groups of filter segments is effected. The groups of segments compiled transversely to the axis of a group of filter segments are then transported using drums or a belt conveyor equipped with flutes for receiving the filter segments. The flutes are arranged transversely to the direction of transport. The filter segments are then delivered to a commonly known device for producing endless filter rod. The crosswise method of compiling multi-segment filters is very expensive since many intermediate drums and cooperating cutting units are used in the apparatus.

Another method of compiling or arranging multi-segment filters is an endwise method. The endwise method has been presented many times in patent descriptions belonging to an English company, MOLINS Ltd. For example, British patent No. GB 971491 discloses a machine for producing multi-segment filters having two different filter segments. The filter is produced by cutting filter rods arranged on periphery of two separate drums using circular knives. Short filter segment elements must be guided over the drums with arch guides arranged coaxially with the drums. The width of the guides is at least half the length of the segments being cut, which may cause the segments to be incorrectly positioned in an uncontrolled manner and, as a result, they may be damaged. A set of cut segments is drawn out of each flute of the drum with the aid of a chain assembly having dogs. The chain assembly always operates in a vertical plane deflected through a slight angle from the axis of the cutting drum. The process of drawing the set of segments out is effected in an uncontrolled manner with the result that single segments may fall out of the set being transported. Moreover when short segments hit the back side of the first segment of the set with a dog, a segment on the opposite end of the set springs back from the rest of segments and moves separately for a short instant, which makes leading the short segments out more difficult. Segments are then displaced from the chain assembly to an intermediate disc with the aid of drivers arranged on periphery of a disc mounted coaxially with a chain sprocket of the chain assembly and are farther displaced in an endwise manner along a horizontal path to a worm drum which controls the flow of segments, whereas prior to entering the worm drum the segments of the other type prepared by cutting filter rods on the other drum are inserted in a similar way into empty spaces between the segments of the first type, the spaces being obtained during separating the segments in a hitting manner. In the said apparatus movement of the segments both on consecutive straight and arch-like parts of segment trajectory, where direction is changed, is effected with different means that must be synchronised with each another. In another version of the said machine presented in a British patent description No. GB 1578738 technical means are applied in order to position and group segments cut on drums prior to advancing them for farther technological operations, whereas filter rods are cut to unequal segments.

The inventive method concerns compiling groups of filter segments according to a continuous endwise manner in a process of producing multi-segment filters used in tobacco industry for cigarettes, where segments in each consecutive module, in which segments of one type are prepared, are passed to a transferring element which displaces the segments onto an exit path. In the method, in each module equal segments of one type are passed at a uniform rate to a transferring element which displaces each segment separately onto the exit path with the aid of drivers radially spaced on periphery of the transferring element, whereas setting of segments of each type in groups of segments positioned repeatedly on the exit path is defined by delay in collecting the segments by the transferring element in each module. Uniform setting of equal segments of one type on the exit path is effected with the aid of the transferring element provided with the drivers spaced uniformly on the periphery of the transferring element and non-uniform setting of equal segments of one type on the exit path is effected with the aid of the transferring element provided with the drivers spaced non-uniformly on the periphery of the transferring element, whereas the setting of the segment on the exit path depends on a distance between the segment passed at the uniform rate to the transferring element and the driver. The presented method enables setting a stream of groups of segments, each group consisting of many segments presenting all types of segments in the demanded filter where the sequence of setting the segments in groups is maintained and repeated.

The subject of the invention is construction of apparatus comprising at least two similar modules, and each module is provided with a cutting drum of a horizontal axis with flutes spaced on the circumference surface, of axes parallel to the axis of the drum, at the inlet the drum being connected to a container of filter rods of length which is n-multiplicity of a segment length, and circular knives cooperating with the drum, whereas filter rods cut into sets of segments are drawn out of the flutes into a guiding channel with the aid of dogs mounted on a loop-closed chain, the trajectory of which, in the area of the sets of the segments being drawn out of flutes is in principle parallel to the axis of the flute, and moreover each module is provided with a separator which separates single segments out of a stream of the sets of the segments, and is also provided with a transferring element, which collects the separated segments and places them onto an exit path.

According to the invention the apparatus is provided with a movable guiding element cooperating in synchronism with the cutting drum, situated by the cutting drum and forming a wall closing the channel for the sets of the segments drawn out of the flutes of the cutting drum, whereas the set of filter segments led through the channel by the dog of the chain is taken possession of by a worm surface of a pushing together drum positioned over the channel, the drum passing the segments for separating, the pitch of the worm surface becoming diminished in direction of movement of the segments down to the value corresponding to the length of the set of filter segments, and the separator of the segment situated at the end of the channel constitutes a disc cam of a rotation axis in principle parallel to the axis of the segment passed for separating, the disc cam pushing the segment out in a direction perpendicular to the axis of the segment passed for separating onto the rotary assembled transferring element between two neighbouring drivers spaced radially on periphery of the transferring element.

It is advantageous that the movable guiding element constitutes a multi-flute rotary assembled shaft, whereas the axes of the flutes of the multi-flute shaft in the area of guiding the set of filter segments being drawn out of the drum may be parallel to the axis of the cutting drum so that the axis of the set of filter segments is in principle parallel to the axis of the cutting drum and the height of the guiding channel is constant or the said axes may be askew to the axis of the cutting drum so that the guiding surface of the shaft is inclined with reference to the axis of the set of filter segments and the height of the guiding channel for the front face of the first segment of the set of filter segments is constant whereas the axis of the set of filter segments is in principle parallel to the axis of the cutting drum.

As an alternative the movable guiding element constitutes an endless belt with flutes in principle parallel to the axis of the cutting drum in the area of the sets of the segments being drawn out of the drum. The cutting drum is provided with a cover over the active part of the drum circumference surface mounted on the housing of the drum and in the cover slots are made for the circular knives which are situated on axes in a support mounted also on the housing of the drum. The said loop-closed chain is guided in a horizontal plane with the aid of sprockets so that the dogs mounted on the chain at equal distances are displaced all the time in a plane parallel to the axis of the cutting drum whereas the sprocket before the cutting drum is displaceable.

It is advantageous that the axis of the pushing together drum is askew to the axis of the set of filter segments in the channel. At the outlet of the channel between the pushing together drum the separator a guide shoe is situated which holds up a consecutive segment in the direction of separating while separating the preceding segment out of the stream of the segments by the separator. Nearby the guide shoe a nozzle supplying compressed air is placed, the nozzle being directed towards the area between the guide shoe and the separator so that the stream of the air helps separating of the segment and stabilizes the segment being separated. The said separator constitutes a disc cam, the periphery of the disc cam constitutes a surface which pushes the segment out, whereas on the periphery there may be more than one pushing out surface and the pushing out surfaces, are spaced uniformly on the periphery of the separator.

As an alternative the separator of the segment may have a form of a disc cam, the periphery of which constitutes a surface which pushes the segment out and moreover the cam has an abutting surface which determines axial speed of the segment being separated which is synchronised with speed imparted to the set of filter segments by the worm surface of the pushing together drum. Such a separator may be provided with more than one abutting surface and more than one pushing out surface, whereas the abutting surface and the pushing out surface are spaced uniformly and the abutting surface of the separator is parallel to the front face of the segment being separated.

It is advantageous that the width of the pushing out surface in the last phase of separating is bigger than the length of the segment. The said transferring element in the periphery area constitutes a unit of two discs spaced at a distance and provided with drivers, whereas between the discs a height adjustable support is situated. The drivers may be mounted on the transferring element in a shifting manner, whereas the drivers may be spaced uniformly or non-uniformly on the periphery of the transferring element. Moreover in the area of pushing out the segment being separated a movable supporting element is situated, speed of which is synchronised with rotational speed of the transferring element, the supporting element being situated so that in the area of pushing the segments out a chamber is formed which is used for instantaneous storing the segment until it is collected by the driver, the chamber being formed at the bottom by the top surface of the adjustable support, at one side by the movable supporting element, at the other side by the pushing out surface of the cam and at the top by the cover of the transferring element.

It is advantageous that the movable supporting element constitutes a disc rotary assembled on the axis perpendicular to the transferring element. As an alternative the movable supporting element constitutes an endless belt with the supporting surface parallel to the transferring element. The individual modules are set according to an endwise manner in any sequence. Due to such construction the apparatus is reliable at high speed of compiling groups of segments on the exit path. The application of the guiding element, which presses gently the set of segments especially the first segment after exiting a flute of the cutting drum, ensures controlled guiding of the set of segments in the channel with the axis of the set being parallel to the axis of the flute while drawing out of the flute, and moreover eliminates the first segment inertial springing back after hitting the last segment in the flute by a dog. Placing the chain in a horizontal plane enables easy adjustment of the trajectory of the chain according to the required width of the cutting drum, whereas the dog always hits the centre of the last segment of the set and the position of the dog over the face of the last segment is maintained while the dog leading the segments along the entire length of the guiding channel. The cover over the active part of the cutting drum ensures stabilization of transported filter rods and also transported segments after cutting rods into the sets of segments.

Applying the drum that pushes the segments together, provided with a worm surface of a variable pitch, enables eliminating a gap between sets of segments which appears after removing a dog in the end part of the channel before separating individual segments, whereas the construction of the separator enables full control of the position of the segments being separated, enables avoiding making the axis of the segment askew and ensures high capacity of the apparatus. The arrangement of the transferring element provided with drivers, the separator, the supporting element, the support and the cover enables creating the chamber, in which a segment separated from a set of segments awaits for collecting by a driver, whereas time of awaiting depends on equal or unequal spacing of drivers on the periphery of the transferring element and defines suitable setting of the segment on the exit path in order to compile a required group of segments.

BRIEF DESCRIPTION OF THE DRAWINGS

Many objects and advantages will be apparent to those skilled in the art when the appended drawings are read in conjunction with this specification, wherein like reference numerals are applied to like elements and wherein.

DETAILED DESCRIPTION OF A PREFERRED EMBODIMENT

Figure 1:
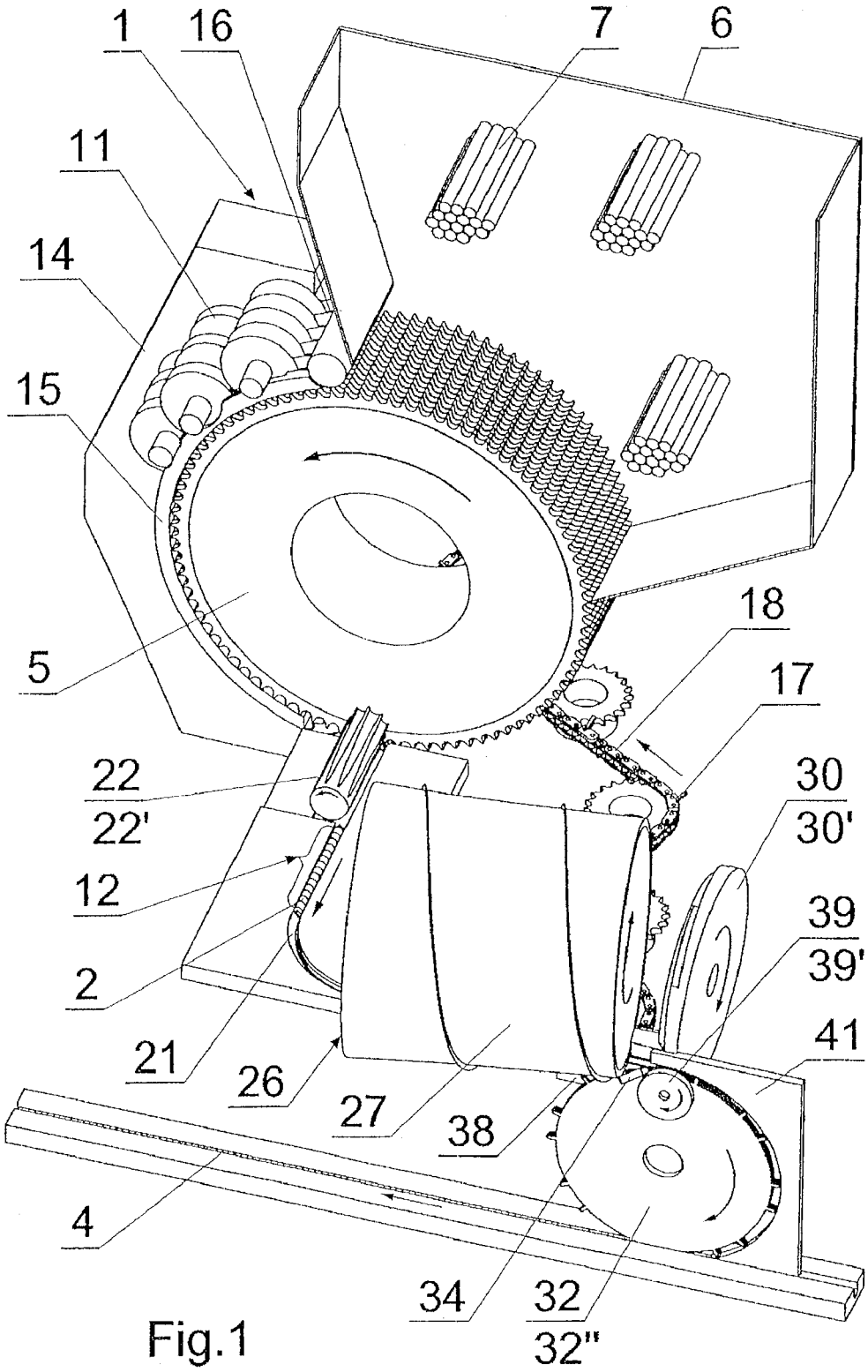
FIG. 1 shows a perspective view a module of the apparatus wherein the guiding element has the form of a multi-flute shaft and the supporting element has the form of a disc, the separator has a pushing-out or expelling surface and an abutting surface, and wherein one set of filter segments of the stream is shown.
Figure 2:
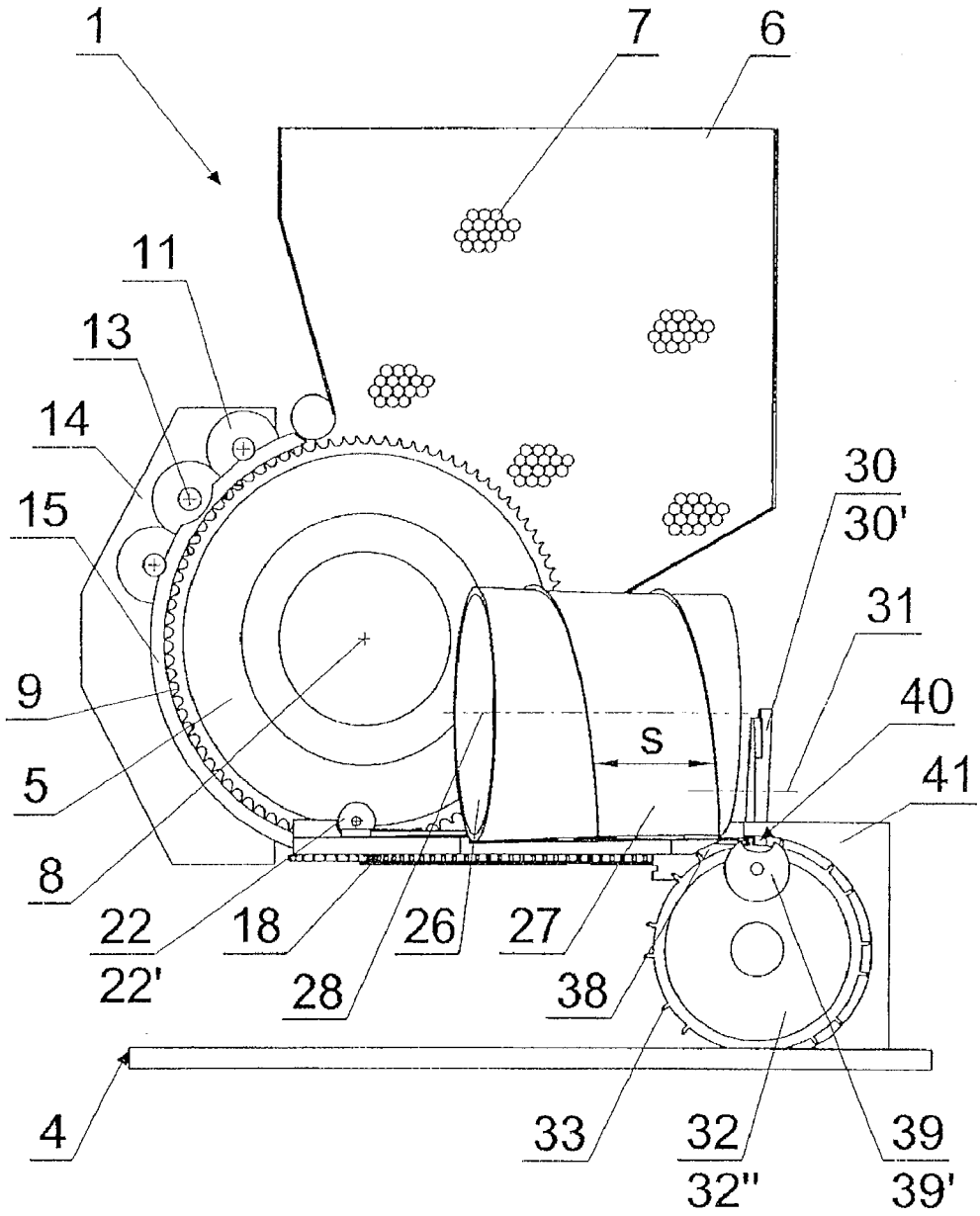
FIG. 2 depicts the module of FIG. 1 in a simplified side view i.e., a nozzle and fragment of the disc of the supporting element are removed.
Figure 3:
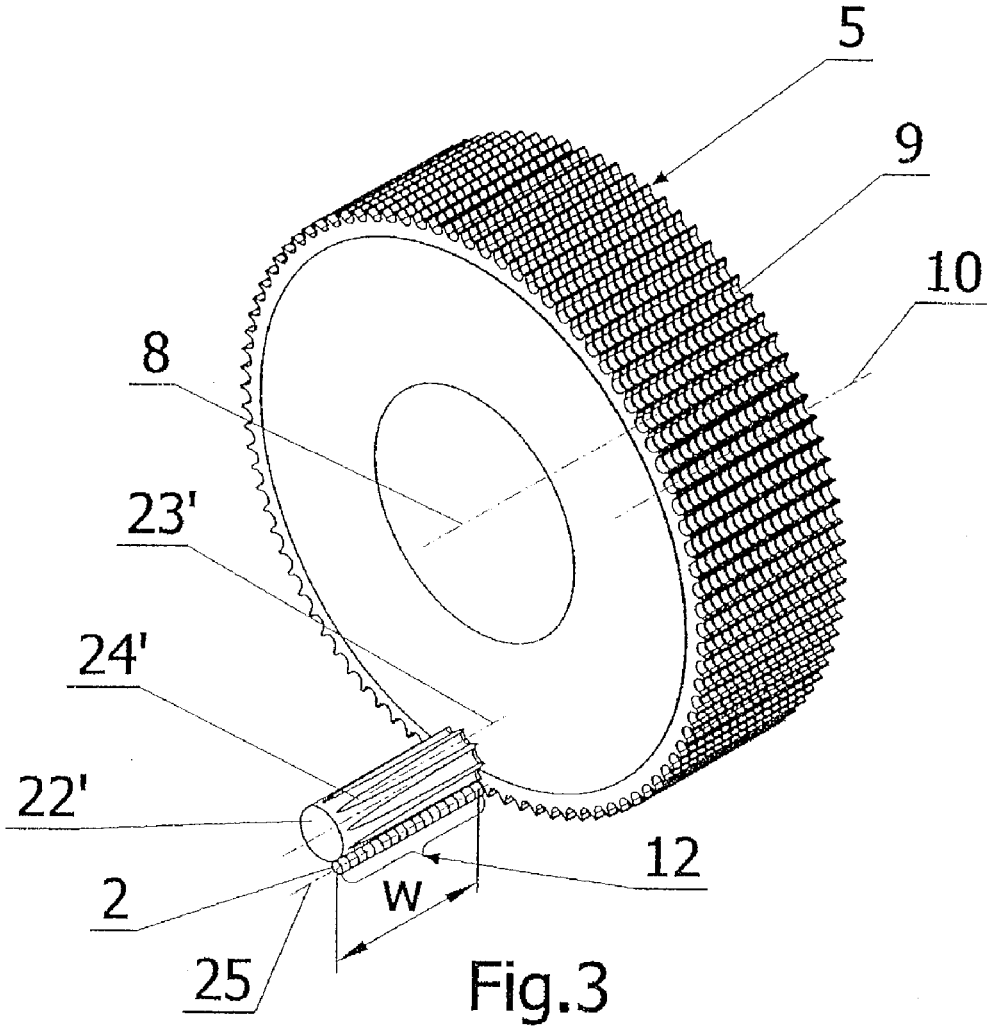
FIG. 3 is a perspective view showing the cutting drum with the guide element in form of a multi-flute shaft and the set of filter segments.
Figure 4:
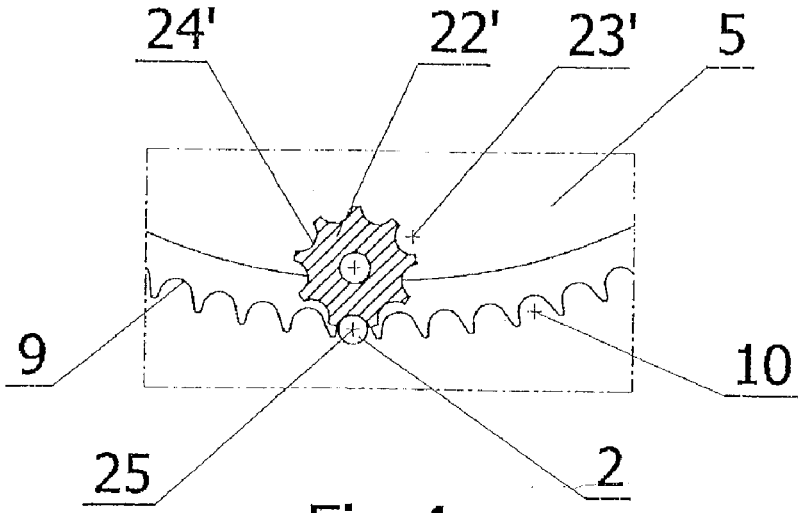
FIG. 4 is an enlarged partial view of FIG. 3 showing the guide element in cross section

The apparatus presented in an exemplary embodiment consists of four similar modules 1, but is not confined, restricted, or limited to the application of any particular number of modules 1. The number of modules 1 is defined by the contents of segments 2 in a cigarette filter. The apparatus enables preparing and compiling groups 3 of segments 2 according to a continuous endwise manner on an exit path 4 of the apparatus in a process of producing multi-segment filters. Each module 1 is provided with a cutting drum 5 placed under a container 6 of filter rods 7 of length constituting n-multiplicity or n-multiples of length in the segment 2. The cutting drum 5 has a horizontal axis 8 (see FIG. 2) and is provided on its periphery with flutes 9 having axes 10 parallel to the axis 8 of the drum 5 (see FIG. 5). Circular knives 11 cooperate with the drum 5 and are arranged so that they cut the filter rod 7 placed in the flute 9 into the segments 2 of equal length—thus creating a set 12 of the segments 2 in the flute 9. The circular knives 11 are arranged on axes 13 (see FIG. 2) positioned on the housing 14 of the cutting drum 5 with a cover 15 over active part of the cutting drum 5 so that knives 11 operate in slots 16 (see FIG. 1) made in the cover 15. Each set 12 of the segments 2 is drawn out of the consecutive flute 9 of the drum 5 with the aid of a dog 17 (see FIG. 6) mounted on a closed-loop or endless chain 18, whereas distances between consecutive dogs 17 correspond to the length w (see FIG. 3) of the set 12 of the segments 2. The chain 18 (see FIG. 6) is guided in a horizontal plane with the aid of sprockets 19 so that the dogs 17 move all the time over a plane parallel to the axis 8 of the cutting drum 5. The sprocket 20 before the cutting drum 5 is displaceably arranged which enables required arrangement of the chain 18 dependent on the width of the cutting drum 5 so that the approximate central position of the dog 17 over the front face of the last segment 2 in the set 12 is maintained. Each set 12 is positioned in stream of the sets 12 in the guiding channel 21 (see FIG. 1) and is displaced all the time with one dog 17 only. By the cutting drum 5 over the guiding channel 21 is placed a movable guiding element 22 which operates in synchronism with the cutting drum 5 and constitutes a wall which closes the channel 21. It is advantageous that the guiding element 22 (see FIG. 3) constitutes a rotary multi-flute shaft 22', whereas axes 23' of flutes 24' of shaft 22' within the area of guiding the withdrawn set 12 of segments 2 may be parallel to the axis 8 of the cutting drum 5 so that axis 25 of the set 12 is in principle parallel to the axis 5 while drawing the set out of the flute 9 of the cutting drum 5 and the height of the guiding channel 21 is constant.

As an alternative the axes 23' of the flutes 24' of the shaft 22' within the area of guiding the drawn set 12 of segments 2 may be askew with reference to the axis 8 of the cutting drum 5 so that the guiding surface of the flute 24' of the shaft 22' is askew with reference to the axis 25 of the set 12 and the height of the guiding channel 21 for the front face of the first segment 2 in the drawn set 12 is constant, whereas the axis 25 of the set 12 while drawing is in principle parallel to the axis 8 of the cutting drum 5.

Figure 5:
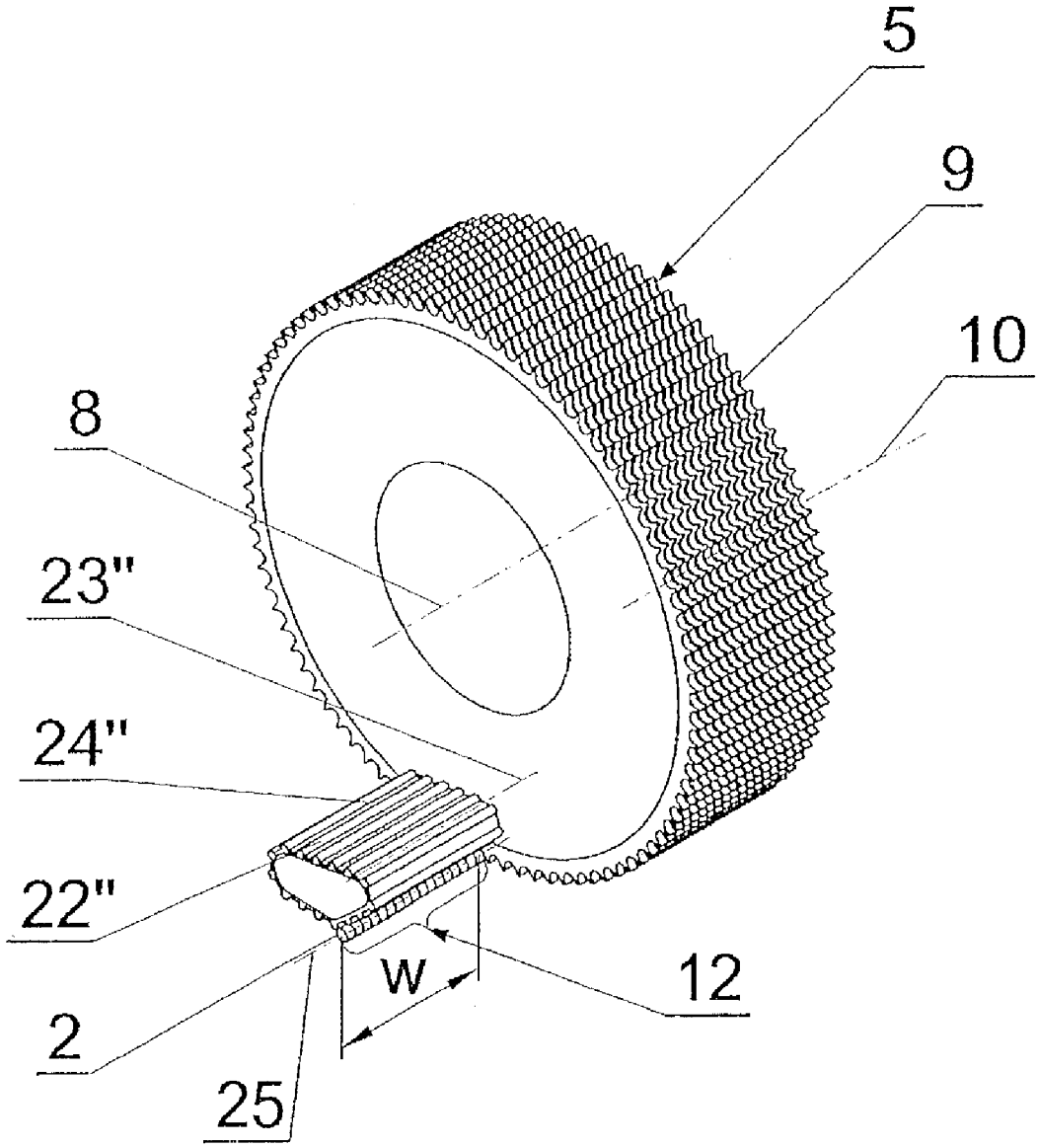
FIG. 5 is a perspective view of the drum of FIG. 3 with an alternative guiding element in form of a belt with flutes applied.
Figure 6:
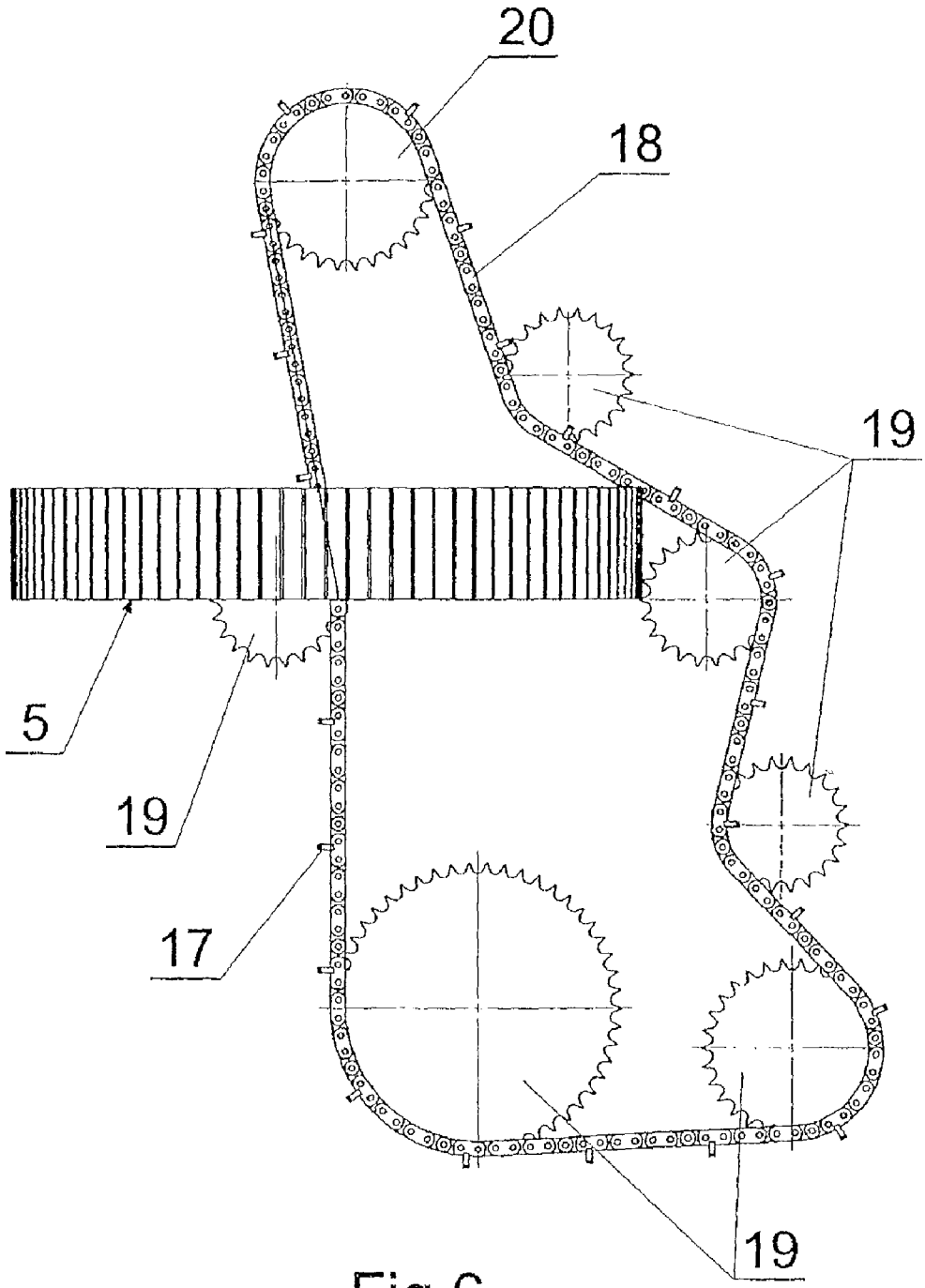
FIG. 6 shows the kinematic scheme of the chain for use with a narrow cutting drum.
Figure 7:
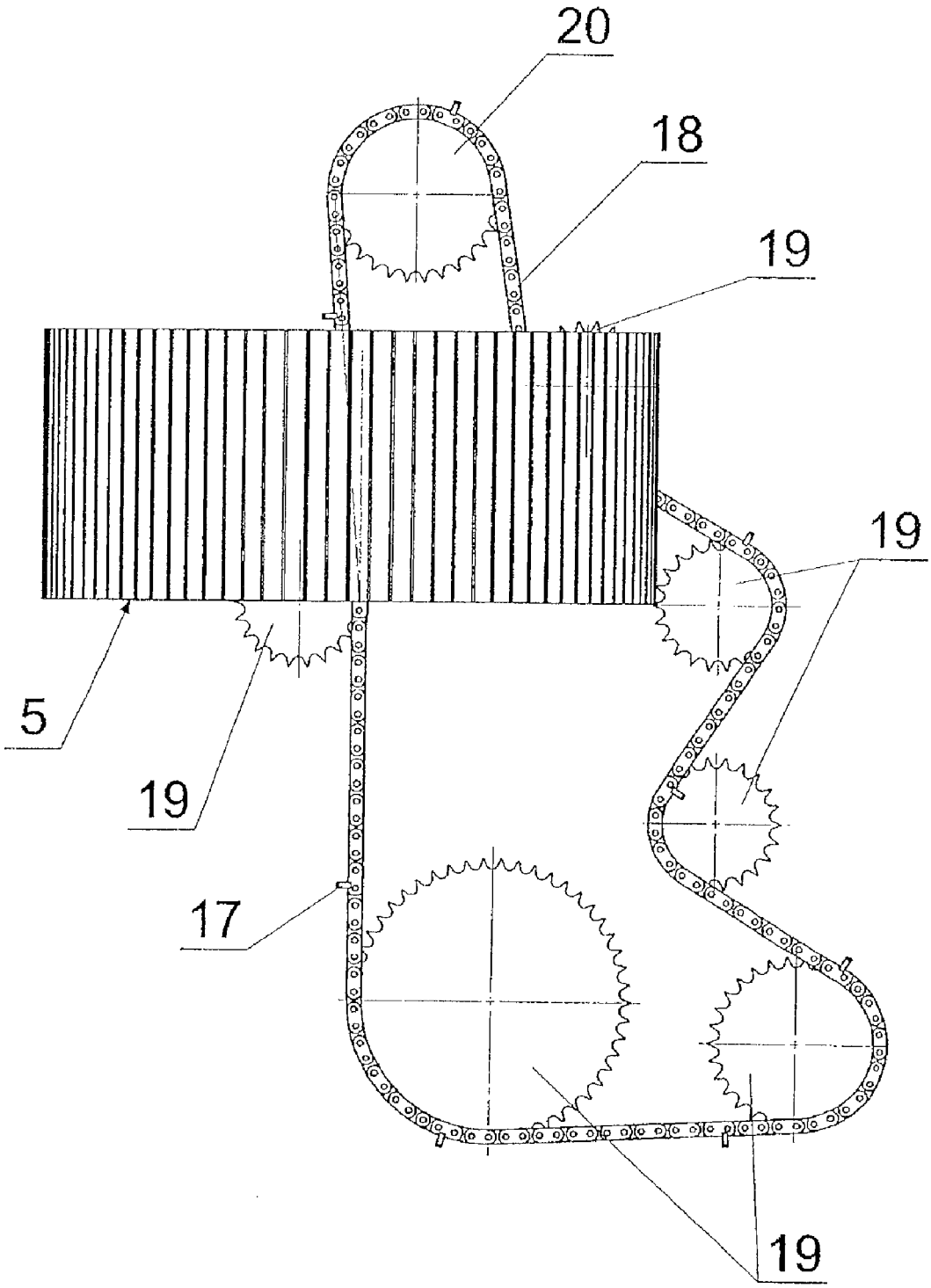
FIG. 7 shows the kinematic scheme for the chain used with a wide cutting drum.

In another solution presented in FIG. 5 the movable guiding element 22 has a form of an endless belt 22" with flutes 24" of axes 23" arranged in general parallel to the axis 8 of the cutting drum 5 in the area of drawing of the set 12 of segments 2. At the end of the guiding channel 21 a drum 26 (see FIG. 1) which pushes the segments together is positioned over the channel 21, the drum being provided with a worm surface 27, the pitch s of the surface (see FIG. 2) diminishes gradually in the direction of movement of segments 2 from the value which enables interception the set of segments by the worm surface 27 of the set 12 of the segments 2 by the dog 17 of the chain 18, down to the value corresponding to the length of the set 12.

Figure 8:
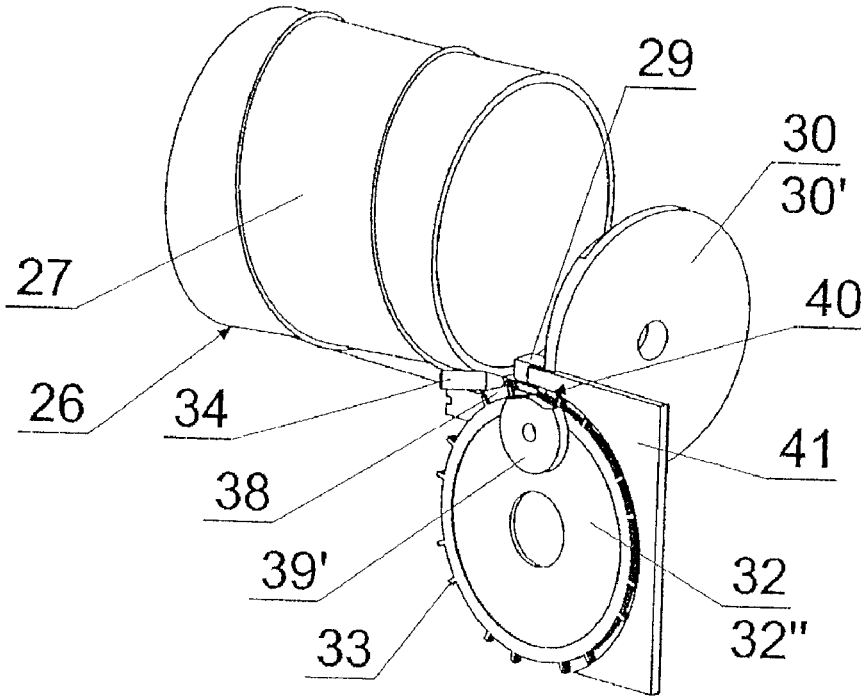
FIG. 8 is an enlarged partial view of the module of FIG. 1 in the area of the segment separation.
Figure 9:
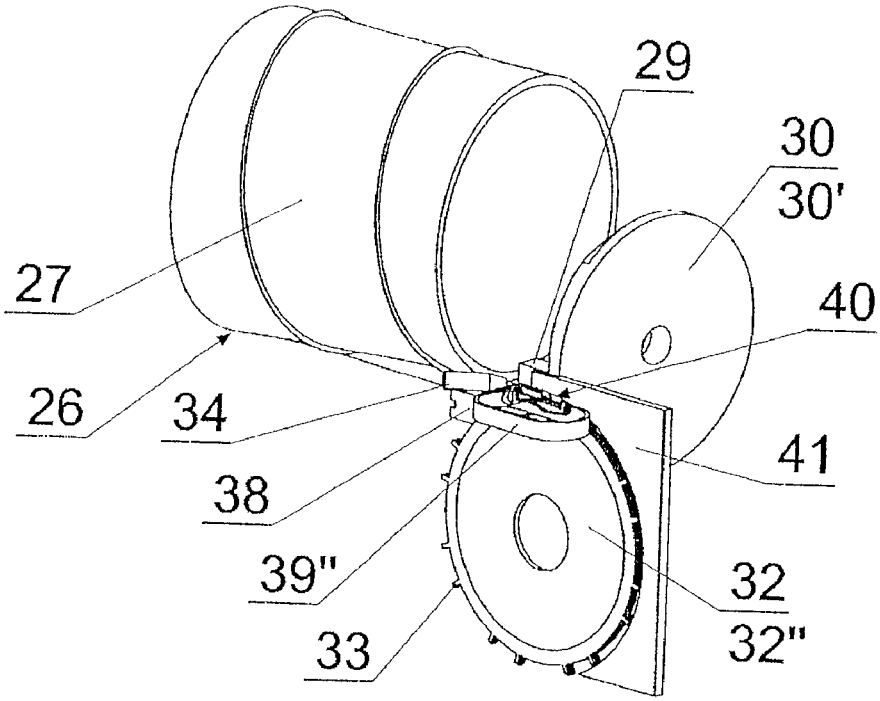
FIG. 9 is an enlarged partial view similar to FIG. 8 depicting an alternative supporting element in form of an endless belt.
Figure 10:
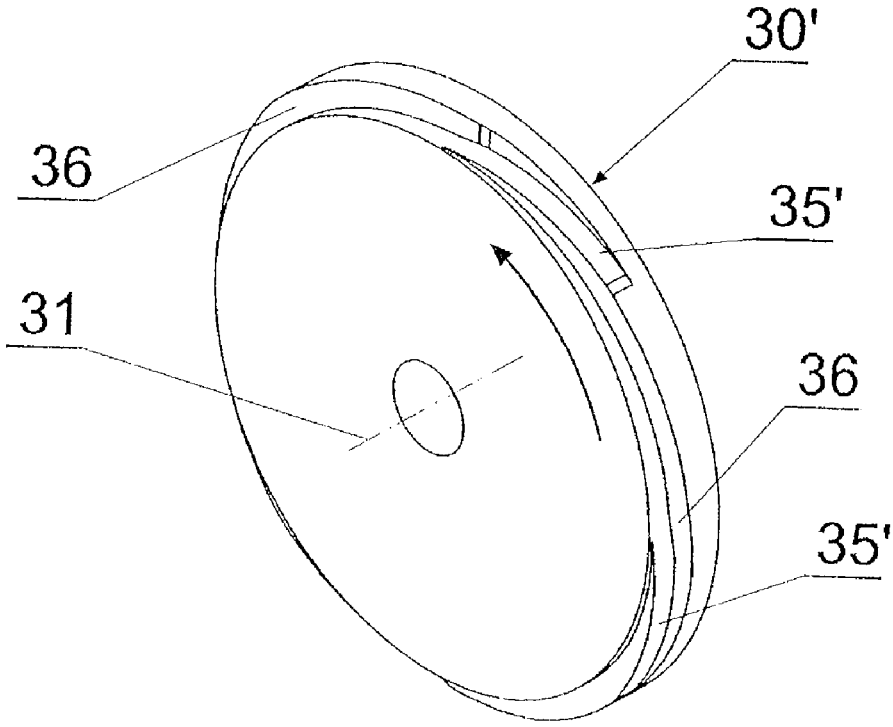
FIG. 10 is a detail view of the segment separator of FIG. 1.
Figure 11:
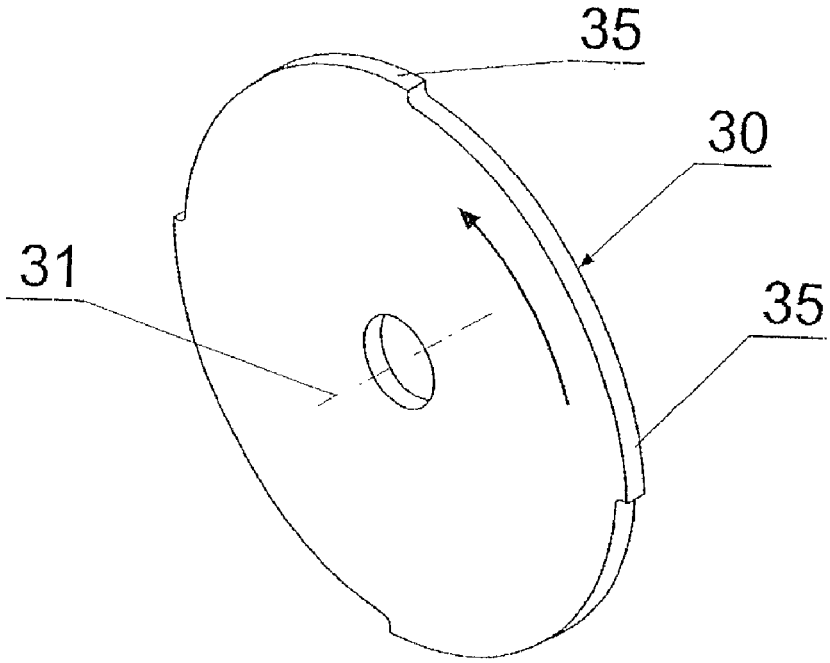
FIG. 11 is a detail view of an alternative segment separator provided with a pushing out surface only.

It is advantageous that the axis 28 of the pushing together drum 26 is askew with reference to the axis 25 of the set 12 of the segments 2 displaced along the channel 21 under the pushing together drum 26. The worm surface 27 of the pushing together drum 26 intercepts the set 12 of the segments 2 from the dog 17 and pushes the segments 2 in a stream, which is passed over to a guide shoe 29 (see FIG. 8) positioned by the outlet of the guiding channel 21. The task for the guide shoe 29 it is to hold up the consecutive segment 2 in the stream of the sets 12 of the segments 2 in the direction of pushing out while separating the preceding segment 2 out of the stream by a separator 30. The separator 30 has a form of a disc cam of an axis 31 in principle parallel to the axis of the segment 2 passed for separating which pushes out the segment 2 perpendicular to its axis over a rotary assembled transferring element 32 between two neighbouring drivers 33 spaced radially on the periphery of the transferring element 32. Nearby the guide shoe 29 is positioned a nozzle 34 supplying compressed air directed towards the area between the guide shoe 29 and the separator 30 so that the stream of the air helps separating of the segment 2 and stabilizes the separated segment 2. The separator 30 may have a form of a disc cam the periphery of which constitutes a pushing out surface 35 of the segment 2, whereas on the periphery there may be more than one pushing out surface 35, and the said surfaces 35 may be spaced uniformly.

In an advantageous embodiment of the apparatus (see FIG. 1) the separator 30' has a form of a disc cam, the periphery of which constitutes a pushing out surface 35', and moreover it has an abutting surface 36 which determines the axial speed of the segment 2 being separated which is synchronised with the speed imparted on the set 12 of the segments 2 by the worm surface 27 of the pushing together drum 26. The said separator 30' may have more than one abutting surface 36 and more than one pushing out surface 35', whereas the said surfaces 36 and 35' may be spaced uniformly and the abutting surface 36 is parallel to the front face of the segment 2 being separated, and the width of the pushing out surface 35' in the last phase of separating the segment 2 is bigger than the length of the segment 2.

Figure 12:
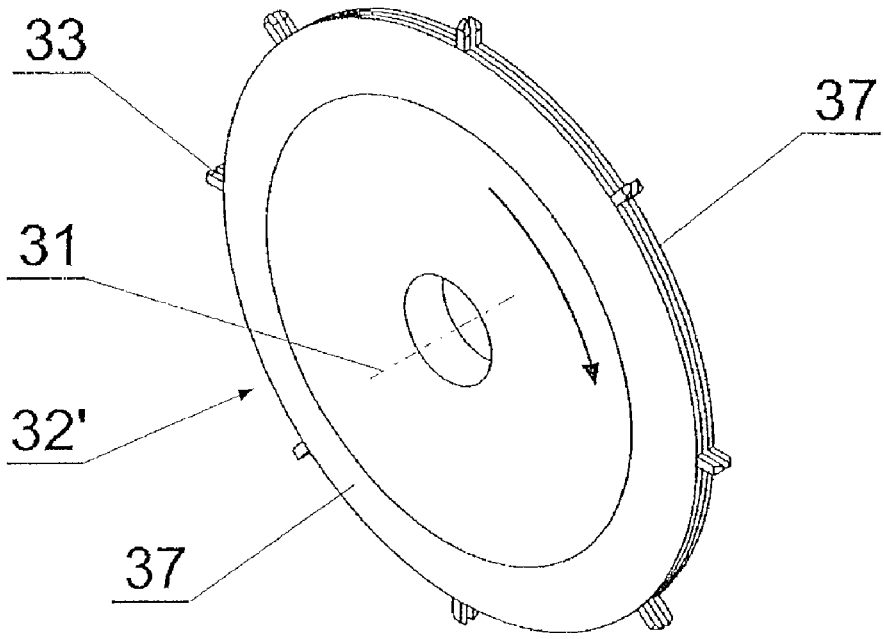
FIG. 12 is a detail view of the transferring element of FIG. 1 with equally spaced drivers.
Figure 13:
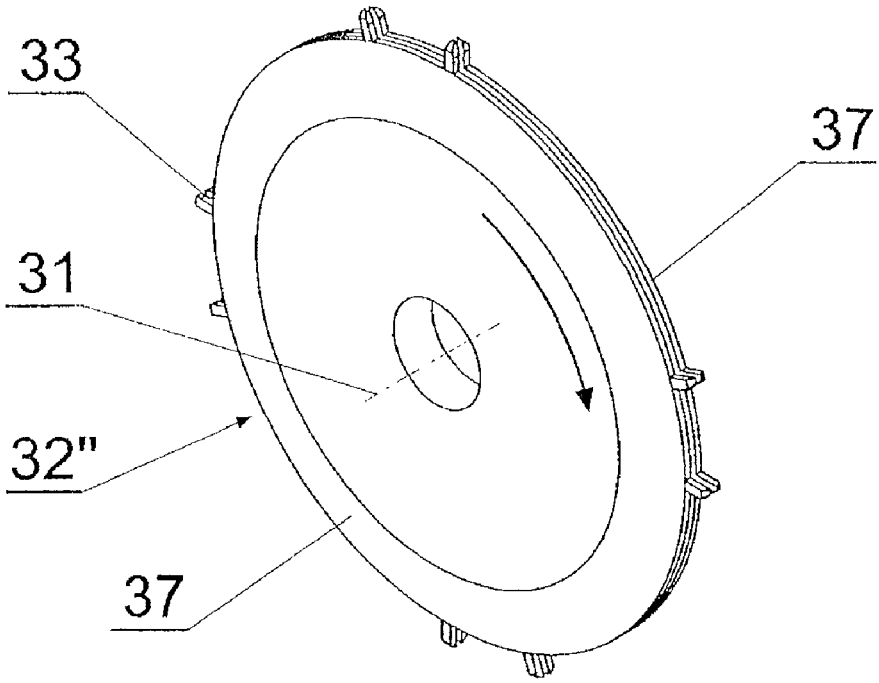
FIG. 13 is a detail view of the transferring element of FIG. 1 with non-equally spaced drivers.

The said transferring element 32 (see FIG. 1) in the periphery area constitutes a unit of two discs 37 (see FIG. 12) slightly spaced at a distance, whereas on each disc 37 there are drivers 33 mounted uniformly and between the discs 37 a height adjustable support 38 (see FIG. 1) is situated. The drivers 33 may be mounted on the transferring element 32 in a shifting manner and moreover they may be spaced uniformly or non-uniformly on the periphery of the transferring element 32. In the area of pushing out the separated segment 2 is situated a movable supporting element 39, the speed of which is synchronised with rotations of the transferring element 32, supporting element positioned so that in the area of separating is created a chamber 40 intended to temporarily store the segment 2 until the moment of collecting it by the driver 33, the chamber being defined at the bottom by the top edge of the support 38, on one side by the side of the movable supporting element 39, on the other side by the pushing out surface 35 or 35' of the separator 30 or 30' and at the top by a cover 41 of the transferring element 32.

It is advantageous that the movable supporting element 39 constitutes a disc 39' (see FIG. 8) rotary assembled or mounted on the axis perpendicular to the transferring element 32. As an alternative the movable supporting element 39 constitutes an endless belt 39" of the supporting surface parallel to the transferring element 32.

Figure 14:
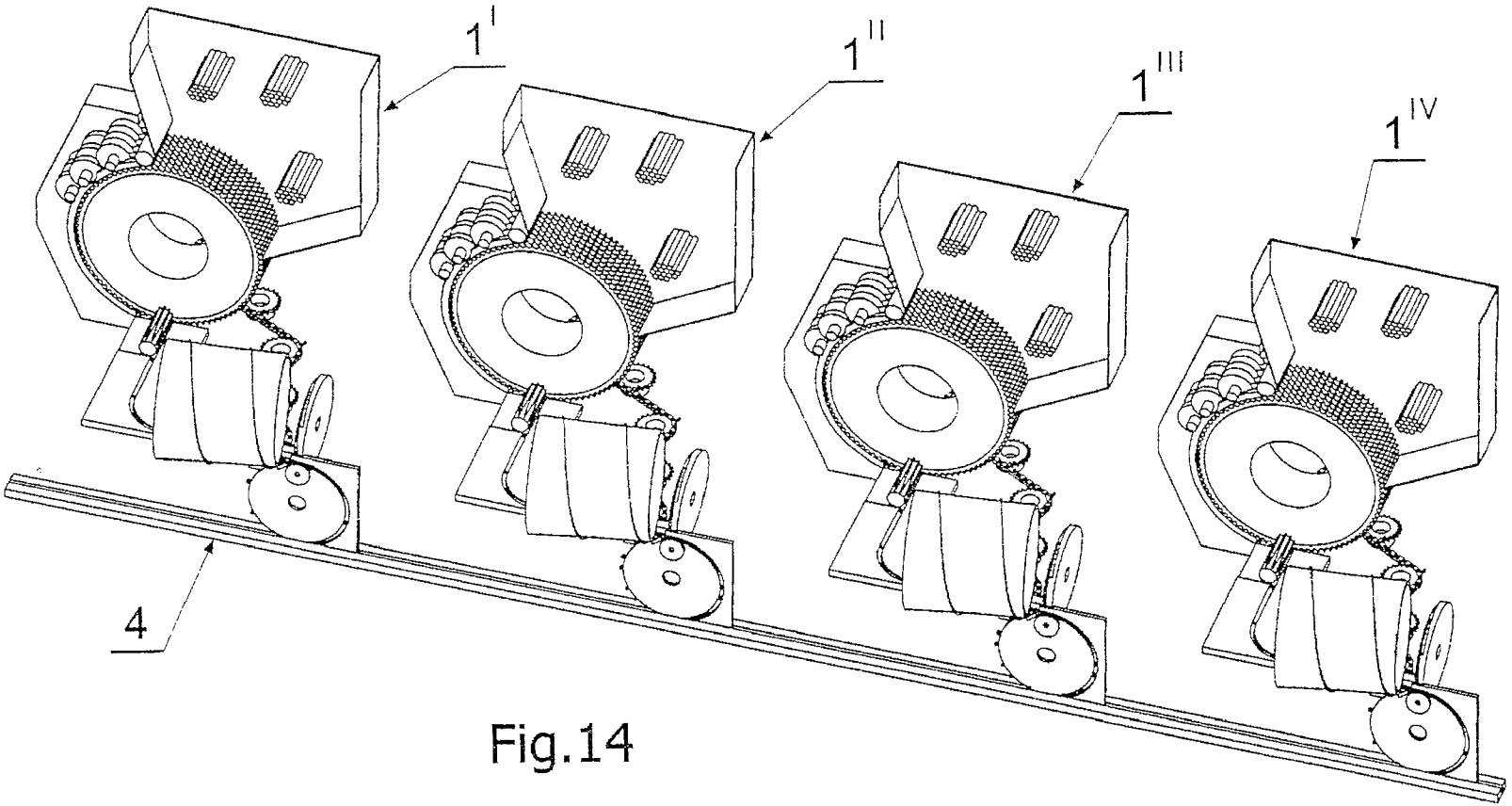
FIG. 14 is a perspective view of apparatus consisting of four modules similar to those of FIG. 1.

In FIG. 14 of the drawing an example of the apparatus is presented, the apparatus is provided with four modules $\mathbf{1}^{I}$, $\mathbf{1}^{II}$, $\mathbf{1}^{III}$ and $\mathbf{1}^{IV}$, whereas the outer modules $\mathbf{1}^{I}$ and $\mathbf{1}^{IV}$ are provided with the transferring element 32' with drivers 33 spaced uniformly and two inner modules $\mathbf{1}^{II}$ and $\mathbf{1}^{III}$ are provided with the transferring element 32" with drivers 33 spaced non-uniformly. In the said example it is advantageous that in the outer modules $\mathbf{1}^{I}$ and $\mathbf{1}^{IV}$ the separator 30 with the pushing out surface 35 is applied and in the inner modules $\mathbf{1}^{II}$ and $\mathbf{1}^{III}$ the separator 30' with the pushing out surface 35' and the abutting surface 36 is applied.

Figure 15:
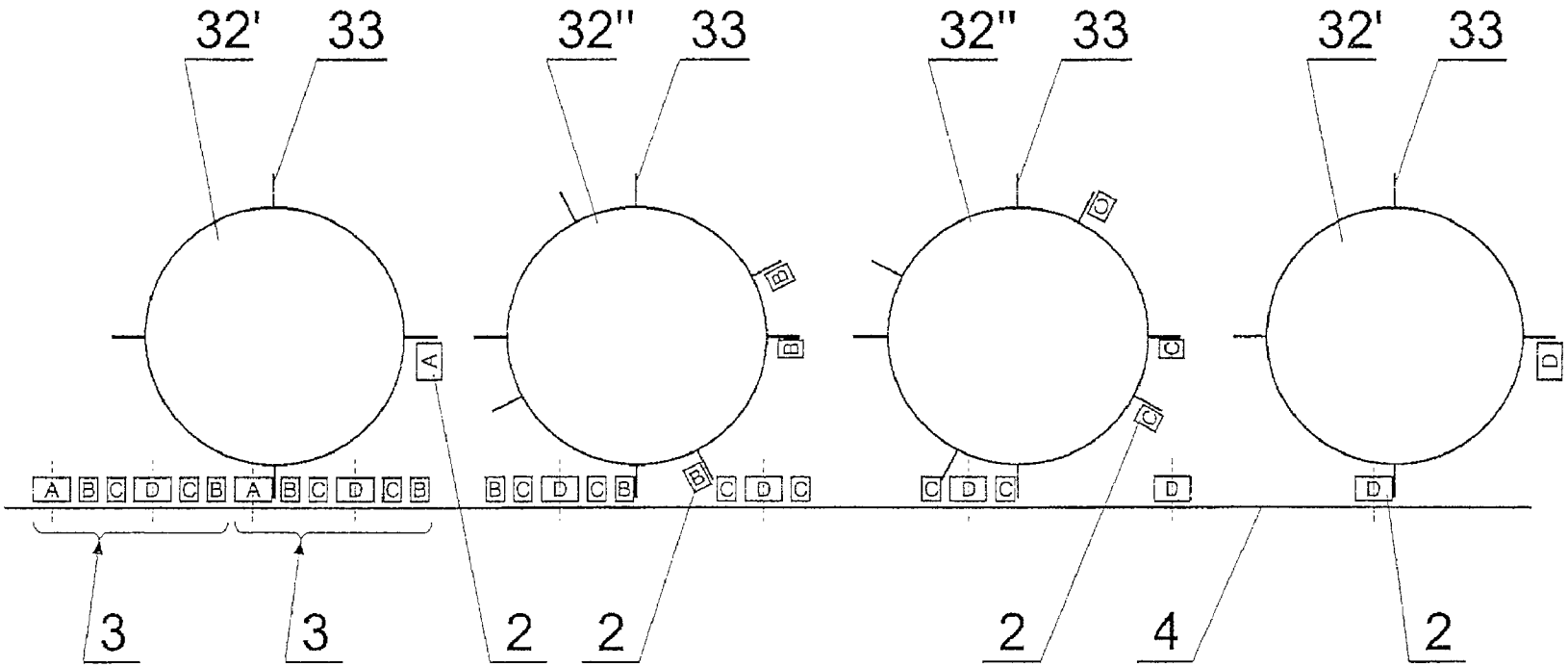
FIG. 15 is a schematic illustration of placing segment groups obtained from the apparatus on the exit path of FIG. 14.

The method of compiling groups 3 of segments 2 on the exit path 4 in the apparatus of FIG. 14 is presented in FIG. 15 of the drawing. The segment 2 passed at a uniform rate by the separator 30 or 30' into the chamber 40 of the transferring element 32 is collected by the driver 33 with the delay dependent on the distance between the driver 33 and the front face of the segment 2 and the delay determines the setting of the segment 2 passed by the transferring element 32 on the exit path 4, whereas uniform setting of equal segments 2 of one type is effected with the aid of the outer transferring elements 32' with the drivers 33 spaced uniformly and non-uniform setting of equal segments 2 of one type is effected with the aid of the inner transferring elements 32" with the drivers 33 spaced non-uniformly.

In the exemplary arrangement (FIG. 15) segments 2D of double length are transferred uniformly onto the exit path 4 with the aid of the transferring element 32' of the uniformly spaced drivers 33, whereas the distance between the consecutive segments 2D constitutes value z. Into the area before and after the segment 2D of double length is placed a segment 2C of single length with the aid of the transferring element 32" of the non-uniformly spaced drivers 33, and then similarly a segment 2B of single length is placed with the aid of the transferring element 32" of the non-uniformly spaced drivers 33 into the area before and after the segment 2C. Finally into the empty space between the segments 2B is placed a segment 2A of double length with the aid of the transferring element 32' of the uniformly spaced drivers 33, whereas the distance between the consecutive segments 2A also constitutes the value z.

Figure 16:
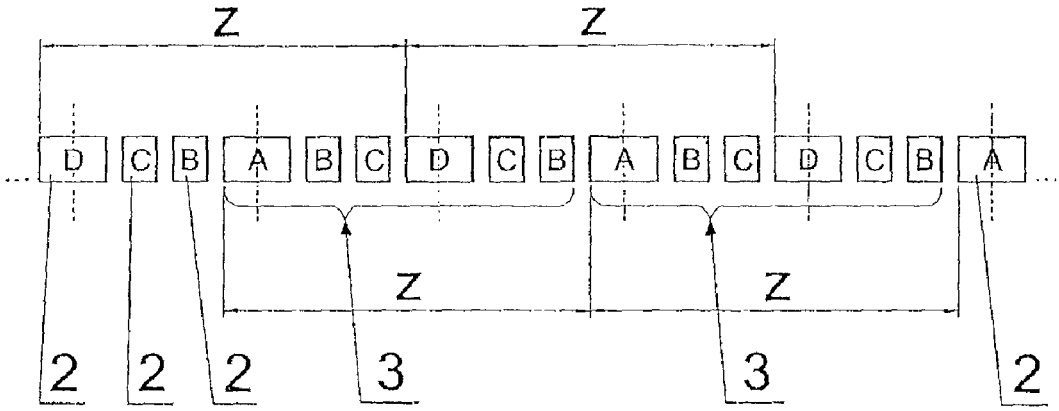
FIG. 16 is a schematic depiction of the stream of sets of filter segments on the exit path.

As a result at the outlet of the exit path 4 is created the stream of the groups 3 of the segments 2 marked one after the other . . . DCBABCDCBABCDCBA . . . (FIG. 16) which enables obtaining identical four segment filters after transversal cutting of the segments 2A and 2D of double length in farther operations of multi-segment filters production. As a result identical filters are obtained consisting of a half of the segment 2A, the segment 2B, the segment 2C and a half of the segment 2D.

When the words "generally" and "substantially" are used herein with respect to geometric terms, the words "generally" and "substantially" are intended to provide tolerance from strict mathematical precision implied by the geometric terms consistent with the ability to provide the requisite function.

Various modifications, variations, substitutions, and equivalents for features of this disclosure will be apparent to those skilled in the art which do not materially depart from the spirit and scope of the invention. Accordingly, it is expressly intended that all such modifications, variations, substitutions, and equivalents which do not depart from the spirit and scope of the invention as defined by the appended claims are encompassed by those appended claims.

The invention claimed is:

1. Apparatus for preparing and arranging filter segments in groups in a continuous endwise manner in a process of producing multi-segment filters used in tobacco industry for cigarettes comprising:

at least two similar modules, each module having a cutting drum with a horizontal axis and flutes spaced on the circumferential surface, the flutes having axes parallel to the axis of the drum, an inlet connecting the drum to a container of filter rods having a length which is n-multiples of a segment length, circular knives cooperating with the drum to cut filter rods in to sets of filter segments, a guiding channel receiving filter rods cut into sets of filter segments drawn out of the flutes;

a closed-loop chain having a plurality of dogs, the chain having a trajectory generally parallel to the axis of a flute in the area of the sets of filter segments drawn out of flutes;

a separator which separates single filter segments from a stream of the set of filter segments;

a transferring element which collects the separated segments and places them onto an exit path;

a movable guiding element cooperating in synchronism with the cutting drum, situated by the cutting drum, and forming a wall closing the guiding channel for sets of filter segments drawn out of the flutes of the cutting drum;

a pushing together drum positioned over the guiding channel, for passing the filter segments for separation, the drum having a worm surface for receiving the set of filter segments led through the channel by a dog of chain; the pitch of the worm surface becoming diminished in direction of movement of the filter segments down to a value corresponding to the length of a set of the filter segments; and a separator for the segment situated at the end of the channel comprising a disc cam having a rotation axis generally parallel to the axis of the filter segment passed for separating, the disc cam pushing the segment out in a direction generally perpendicular to the axis of the filter segment passed for separating onto the rotary mounted transferring element between two radially spaced, neighbouring drivers on the periphery of the transferring element.

2. Apparatus according to claim 1, wherein the movable guiding element comprises a multi-flute rotary mounted shaft.

3. Apparatus according to claim 2, wherein the axes of the flutes of the multi-flute shaft in the area of guiding the set of filter segments being drawn out of the drum are generally parallel to the axis of the cutting drum so that the axis of the set of filter segments is generally parallel to the axis of the cutting drum; and the height of the guiding channel is substantially constant.

4. Apparatus according to claim 2, wherein the axes of the flutes of the multi-flute shaft in the area of guiding the set of filter segments being drawn out of the drum are askew to the axis of the cutting drum so that the guiding surface of the flute of the shaft is inclined relative to the axis of the set of filter segments; the height of the guiding channel for the front face of the first filter segment of the set of filter segments is substantially constant; and the axis of the set of filter segments is generally parallel to the axis of the cutting drum.

5. Apparatus according to claim 1, wherein the movable guiding element comprises an endless belt with flutes having axes generally parallel to the axis of the cutting drum in the area of the sets of filter segments being drawn out of the drum.

6. Apparatus according to claim 1, wherein the cutting drum includes a surface mounted cover on the housing of the drum over the active part of the drum circumference; slots in the cover accommodate the circular knives situated on support axes also mounted also on the drum housing.

7. Apparatus according to claim 1, wherein the closed-loop chain is guided in a substantially horizontal plane with sprockets so that the dogs mounted on the chain at substantially equal distances are displaced in a plane generally parallel to the axis of the cutting drum; and wherein one sprocket adjacent to the cutting drum is displaceable.

8. Apparatus according to claim 1, wherein the axis of the pushing together drum is askew relative to the axis of the set of filter segments in the channel.

9. Apparatus according to claim 1, wherein a guide shoe positioned at the outlet of a channel between the pushing together drum and the separator holds up a subsequent segment of the stream of the sets of filter segments in the direction of separating, while the separator separates the preceding segment.

10. Apparatus according to claim 9, further including a nozzle supplying compressed air, the nozzle being placed nearby the guide shoe and being directed towards the area between the guide shoe and the separator so that the stream of the air helps separate and stabilize the segment being separated.

11. Apparatus according to claim 1, wherein the separator comprises a disc cam, the periphery of the disc cam including a surface which pushes the filter segment out.

12. Apparatus according to claim 11, wherein the periphery of the separator includes more than one pushing out surface.

13. Apparatus according to claim 12, wherein the pushing out surfaces are spaced uniformly on the periphery of the separator.

14. Apparatus according to claim 1, wherein the separator of filter segments comprises a disc cam, the periphery of the disc cam includes a surface which pushes the segment out, and an abutting surface.

15. Apparatus according to claim 14, wherein the abutting surface is synchronised with speed imparted to the set of filter segments by the worm surface of the pushing together drum and the abutting surface determines the axial speed of the filter segment being separated.

16. Apparatus according to claim 15, wherein the abutting surface and the pushing out surface of the separator are uniformly spaced.

17. Apparatus according to claim 14, wherein the separator is provided with more than one abutting surface and more than one pushing out surface.

18. Apparatus according to claim 14, wherein the abutting surface of the separator is generally parallel to the front face of the filter segment being separated.

19. Apparatus according to claim 14, wherein the width of the pushing out surface in the last phase of filter segment separation is greater than the length of the filter segment.

20. Apparatus according to claim 1, wherein the transferring element comprises two spaced discs provided with drivers, and wherein a height adjustable support is situated between the discs.

21. Apparatus according to claim 1, wherein the drivers are adjustably mounted on the transferring element.

22. Apparatus according to claim 1, wherein the drivers are spaced uniformly on the periphery of the transferring element.

23. Apparatus according to claim 1, wherein the drivers are non-uniformly spaced on the periphery of the transferring element.

24. Apparatus according to claim 1, wherein a movable supporting element is situated in the area of the filter segment being separated, the speed of the supporting element is synchronised with rotational speed of the transferring element, the supporting element being situated so that a chamber is formed for instantaneous storing the filter segment until it is collected by the driver, the chamber having a bottom formed by the top surface of the adjustable support, one side formed by the movable supporting element, the other side formed by the pushing out surface of the separator and the top formed by the cover of the transferring element.

25. Apparatus according to claim 24, wherein the movable supporting element comprises a disc rotary mounted on an axis generally perpendicular to the transferring element.

26. Apparatus according to claim 24, wherein the movable supporting element constitutes an endless belt with the supporting surface generally parallel to the transferring element.

27. Apparatus according to claim 1, wherein individual modules are arranged in an endwise manner.

* * * * *